US008805247B2

(12) United States Patent
Takahashi

(10) Patent No.: US 8,805,247 B2
(45) Date of Patent: Aug. 12, 2014

(54) IMAGE FORMING APPARATUS

(75) Inventor: Yoshihiko Takahashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 245 days.

(21) Appl. No.: 13/217,872

(22) Filed: Aug. 25, 2011

(65) Prior Publication Data

US 2012/0051773 A1 Mar. 1, 2012

(30) Foreign Application Priority Data

Aug. 31, 2010 (JP) ..... 2010-193118

(51) Int. Cl.
*G03G 15/08* (2006.01)

(52) U.S. Cl.
USPC ..... 399/257; 399/53; 399/101

(58) Field of Classification Search
USPC ..... 399/53, 66, 72, 257
See application file for complete search history.

(56) References Cited

U.S. PATENT DOCUMENTS

| | | | | |
|---|---|---|---|---|
| 2005/0201775 | A1* | 9/2005 | Ikeda | 399/101 |
| 2007/0116483 | A1* | 5/2007 | Kobayashi et al. | 399/49 |
| 2007/0201897 | A1* | 8/2007 | Maeda et al. | 399/101 |
| 2010/0165398 | A1* | 7/2010 | Watanabe | 358/1.15 |

FOREIGN PATENT DOCUMENTS

| | | | |
|---|---|---|---|
| JP | 08-063010 | A | 3/1996 |
| JP | 2000-214644 | A | 8/2000 |
| JP | 2002-072713 | A | 3/2002 |
| JP | 2005-258125 | A | 9/2005 |
| JP | 2007-108589 | A | 4/2007 |
| JP | 2009-288481 | A | 12/2009 |

* cited by examiner

*Primary Examiner* — David Gray
*Assistant Examiner* — Thomas Giampaolo, II
(74) *Attorney, Agent, or Firm* — Kubotera & Associates, LLC

(57) ABSTRACT

An image forming apparatus includes a developer image forming portion for forming a developer image; a primary transfer member for transferring the developer image to an intermediate transfer member; a secondary transfer member for transferring the developer image to a recording medium; a medium transportation unit for transporting the recording medium to a secondary transfer position; a contact cleaning member for cleaning the secondary transfer member; a voltage control unit for applying a transfer voltage to the primary transfer member and the secondary transfer member; and a control unit for controlling the developer image portion, the primary transfer member, the secondary transfer member and the medium transportation unit. The control unit is arranged to perform a developer discarding operation, in which the developer image portion forms a discard developer image, and the discard developer image is transferred to the intermediate transfer member and to the secondary transfer member.

12 Claims, 7 Drawing Sheets

IMAGE FORMING APPARATUS

BACKGROUND OF THE INVENTION AND RELATED ART STATEMENT

The present invention relates to an image forming apparatus. More specifically, the present invention relates to an image forming apparatus capable of transferring a developer image formed on an image supporting member to form an image.

In a conventional image forming apparatus, a developer image formed on a photosensitive drum is transferred to an intermediate transfer member such as a transfer drum in a primary transfer process. Then, the developer image on the intermediate transfer member is transferred to a transfer material with a secondary transfer member such as a transfer roller sandwiching the intermediate transfer member and the transfer material such as a printing sheet in a secondary transfer process. A cleaning blade is disposed to abut against each of the intermediate transfer member and the secondary transfer member for cleaning (refer to Patent Reference).

Patent Reference Japanese Patent Publication No. 08-63010

In the conventional image forming apparatus, when a printing sheet having a size smaller than an image to be transferred is used, developer may attach to the secondary transfer member, thereby causing a stain in a subsequent printing operation. Accordingly, it is necessary to arrange the cleaning member to abut against the secondary transfer member for cleaning.

As explained above, in the conventional image forming apparatus, the cleaning member is arranged to abut against the secondary transfer member for cleaning. However, it is difficult to properly arrange the cleaning member for cleaning. In this case, an image formed on the printing sheet tends to be deteriorated.

In view of the problems described above, an object of the present invention is to provide an image forming apparatus capable of solving the problems of the conventional image forming apparatus.

Further objects and advantages of the invention will be apparent from the following description of the invention.

SUMMARY OF THE INVENTION

In order to attain the objects described above, according to an aspect of the present invention, an image forming apparatus includes a developer image forming portion for forming a developer image; a primary transfer member for transferring the developer image formed with the developer image forming portion to an intermediate transfer member; a secondary transfer member for transferring the developer image transferred with the primary transfer member to at least a recording medium; a medium transportation unit for transporting the recording medium to a secondary transfer position where the secondary transfer member transfers the developer image to the recording medium; a contact cleaning member for cleaning the secondary transfer member; a voltage control unit for applying a transfer voltage to the primary transfer member and the secondary transfer member; and a control unit for controlling at least the developer image portion, the primary transfer member, the secondary transfer member and the medium transportation unit.

According to the aspect of the present invention, the control unit is arranged to perform a developer discarding operation, in which the developer image forming portion forms a discard developer image, the discard developer image is transferred to the intermediate transfer member, and the discard developer image transferred to the intermediate transfer member is transferred to the secondary transfer member.

In the aspect of the present invention, developer is attached to the secondary transfer member. Accordingly, developer functions as lubricant for the contact cleaning member for cleaning the secondary transfer member. As a result, it is possible to prevent the contact cleaning member from excessively deforming at a contact portion thereof with respect to the secondary transfer member.

DETAILED DESCRIPTION OF PREFERRED EMBODIMENTS

Hereunder, embodiments of the present invention will be explained with reference to the accompanying drawings.

First Embodiment

Figure 1:
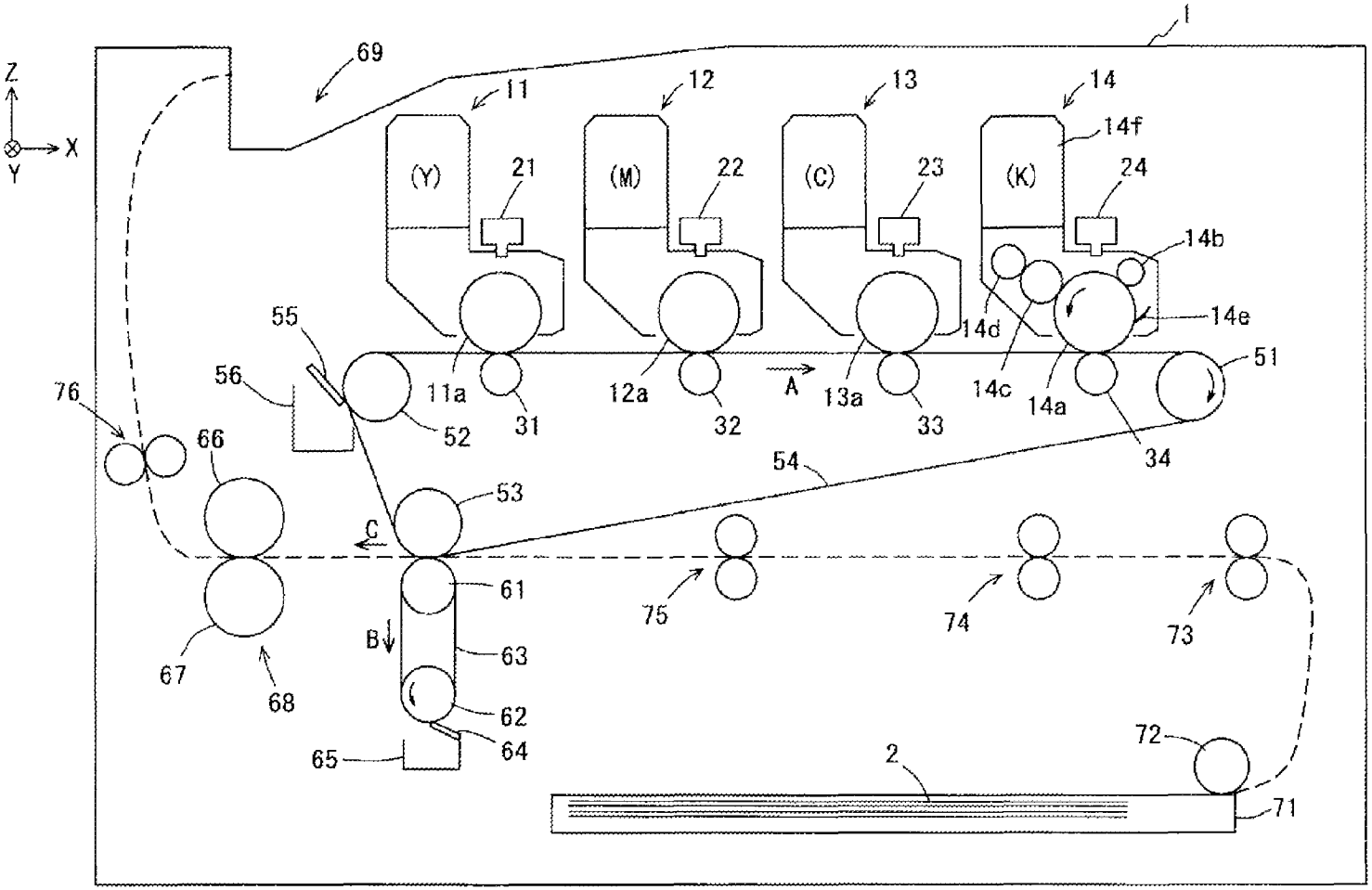
FIG. 1 is a schematic sectional view showing a configuration of a printer according to a first embodiment of the present invention.

A first embodiment of the present invention will be explained. FIG. 1 is a schematic sectional view showing a configuration of a printer 1 as an image forming apparatus according to the first embodiment of the present invention.

As shown in FIG. 1, the printer 1 includes an intermediate transfer belt 54 as an intermediate transfer member arranged to move along a moving path. The intermediate transfer belt 54 is formed of a semi-conductive plastic film with high resistivity in an endless shape without a joined portion. The intermediate transfer belt 54 is disposed between a drive roller 51, a belt follower roller 52, and a backup roller 53, so that the drive roller 51 drives the intermediate transfer belt 54 to rotate in an arrow direction A. A belt motor 114 (refer to FIG. 2) drives the drive roller 51 to rotate (described later).

In the embodiment, the printer 1 includes an image drum unit 11 (referred to as an ID unit 11) for forming a toner image in yellow (Y), an ID unit 12 for forming a toner image in magenta (M), an ID unit 13 for forming a toner image in cyan (C), and an ID unit 14 for forming a toner image in black (K). The ID units 12 to 14 are detachably arranged in a row along the intermediate transfer belt 54 between the belt follower roller 52 and the drive roller 51 in an order from an upstream side of the moving direction of the intermediate transfer belt 54. In the ID units 12 to 14, the toner images in corresponding colors are formed on photosensitive drum 11*a*, 12*a*, 13*a*, and 14*a*.

In FIG. 1, an X axis is aligned with the moving direction of the intermediate transfer belt 54 between the belt follower roller 52 and the drive roller 51. A Y axis is aligned with a rotational shaft direction of each of the photosensitive drum 11*a*, 12*a*, 13*a*, and 14*a* (described later). A Z axis is aligned with a direction perpendicular to both the X axis and the Y axis. It is noted that the Z axis is aligned with a substantial vertical direction.

In the embodiment, the ID units 12 to 14 have an identical configuration. In the following description, an internal configuration of the ID unit 14 of black (K) will be explained as an example.

In the embodiment, the ID unit 14 includes the photosensitive drum 14*a* arranged to be rotatable in an arrow direction. A charging roller 14*b* is disposed around the photosensitive drum 14*a* to contact with a surface of the photosensitive drum 14*a* with a specific pressure for supplying electric charges to the surface, so that the surface is uniformly charged. An LED (Light Emitting Diode) head 24 is disposed around the photosensitive drum 14*a* for selectively irradiating the surface of the photosensitive drum 14*a* thus charged, so that a static latent image is formed on the surface. The charging roller 14*b* and the LED head 24 are arranged in this order from an upstream side in a rotational direction of the photosensitive drum 14*a*. The LED heads 21 to 24 are arranged to be detachable relative to the ID units 11 to 14. It is noted that the LED heads 21 to 24 and the ID units 11 to 14 constitute a developer image forming portion.

In the embodiment, the ID unit 14 further includes a developing roller 14*c* and a cleaning blade 14*e*. The developing roller 14*c* is provided for attaching toner in a specific color (black in this case) to an area of the surface of the photosensitive drum 14*a* where the static latent image is formed to develop the static latent image, thereby forming a toner image. The cleaning blade 14*e* is provided for removing remaining toner when the toner image on the photosensitive drum 14*a* is transferred to the intermediate transfer belt 54. The cleaning blade 14*e* is formed of an elastic member, and has an edge portion arranged to contact with the surface of the photosensitive drum 14*a* with a constant pressure.

In the embodiment, the ID unit 14 further includes a supply roller 14*d* and a toner cartridge 14*f*. The supply roller 14*d* is arranged to contact with the developing roller 14*c* for supplying toner to the developing roller 14*c* and charging through friction. The toner cartridge 14*f* is disposed above the developing roller 14*c* and the supply roller 14*d* for storing toner to be supplied to the supply roller 14*d*. The toner cartridge 14*f* stores toner in black (K), and is arranged to be detachable relative to a main body of the ID unit 14. An ID motor 115 (refer to FIG. 2) transmits drive power through a gear and the like to the rotational members described above to rotate.

In the embodiment, primary transfer rollers 31 to 34 are disposed to face the photosensitive drums 11*a* to 14*a* of the ID units 11 to 14 with the intermediate transfer belt 54 in between. The primary transfer rollers 31 to 34 are arranged to sandwich the intermediate transfer belt 54 with the photosensitive drums 11*a* to 14*a* such that the intermediate transfer belt 54 can move in the arrow direction A. The photosensitive drums 11*a* to 14*a* are arranged to contact with the intermediate transfer belt 54 primary transfer positions, so that the primary transfer rollers 31 to 34 sequentially overlap and transfer (primary transfer) the toner images in color formed on the surfaces of the photosensitive drums 11*a* to 14*a* to the intermediate transfer belt 54. When the primary transfer rollers 31 to 34 perform the primary transfer, a primary transfer voltage control unit 106 (refer to FIG. 2) applies a specific transfer voltage to the primary transfer rollers 31 to 34 (described later).

In the embodiment, a cleaning blade 55 is arranged to contact with the intermediate transfer belt 54 at a position where the cleaning blade 55 faces the belt follower roller 52. The cleaning blade 55 is provided for scraping off a foreign matter such as toner attached to the surface of the intermediate transfer belt 54. A cleaner container 56 is provided for collecting the foreign matter scraped off with the cleaning blade 55.

In the embodiment, a secondary transfer belt 63 is formed of a semi-conductive plastic film with a high resistivity, and is formed in an endless shape without a joined portion. The secondary transfer belt 63 is disposed between a drive roller 62 and a secondary transfer roller 61, so that the drive roller 62 drives the secondary transfer belt 63 to rotate in an arrow direction B.

In the embodiment, the secondary transfer roller 61 is arranged to press against the backup roller 53, so that the intermediate transfer belt 54 and the secondary transfer belt 63 form a nip portion to be a secondary transfer position. Further, the secondary transfer roller 61 is arranged such that a rotational axis of the secondary transfer roller 61 is aligned with a rotational axis of the backup roller 53 along a substantially Z axis. It is noted that the secondary transfer belt 63, the secondary transfer roller 61, and the drive roller 62 constitute a secondary transfer member.

In the embodiment, a secondary transfer motor 117 (refer to FIG. 2) is provided for driving the drive roller 62 to rotate, so that the secondary transfer belt 63 moves in an arrow direction C at a moving speed the same as that of the intermediate transfer belt 54 at the nip portion. A cleaning blade 64 is arranged to contact with the secondary transfer belt 63 at a position where the cleaning blade 64 faces the drive roller 62. The cleaning blade 64 is provided for scraping off a foreign matter such as toner attached to a surface of the secondary transfer belt 63. A cleaner container 65 is provided for collecting the foreign matter scraped off with the cleaning blade 64.

In the embodiment, a recording medium storage cassette 71 is detachably attached to a lower portion of the printer 1 for placing a recording sheet 2 as a recording medium. A separation member (not shown) and a hopping roller 72 are disposed for picking up the recording sheet 2 placed in the recording medium storage cassette 71 one by one at a specific timing. A register roller pair 73 and a pair of transportation rollers 74 and 75 are disposed for transporting the recording sheet 2 toward the nip portion of the intermediate transfer belt 54 and the secondary transfer belt 63.

In the embodiment, a hopping motor 111 (refer to FIG. 2) is provided for driving the hopping roller 72 to rotate (described later). A register motor 112 (refer to FIG. 2) is provided for driving the register roller pair 73 to rotate (described later). A transportation motor 113 (refer to FIG. 2) is provided for driving the transportation rollers 74 and 75 and a transportation roller pair 76 to rotate (described later). It is noted that a transportation path of the recording sheet 2 is represented with a hidden line in FIG. 1. Further, it is noted that the hopping roller 72, the register roller pair 73, and the transportation rollers 74 and 75 constitute a medium transportation portion.

In the embodiment, the secondary transfer belt 63 and the drive roller 62 transfer (secondary transfer) the toner images transferred to the intermediate transfer belt 54 to the recording sheet 2 transported to the nip portion. When the secondary transfer belt 63 and the drive roller 62 perform the secondary transfer, a secondary transfer voltage control unit 107 (refer to FIG. 2) applies a specific transfer voltage to the secondary transfer roller 61 (described later).

In the embodiment, the printer 1 further includes a fixing unit 68. The fixing unit 68 includes a heat roller 66 with a heat source provided therein and a pressing roller 67 urged against the heat roller 66 with an urging member (not shown). When the recording sheet 2 passes through between the heat roller 66 and the pressing roller 67, the fixing unit 68 fixes the toner images transferred to the recording sheet 2 through heat and pressure. The transportation roller pair 76 is provided for discharging the recording sheet 2 to a stacker portion 69 disposed outside the printer 1.

Figure 2:
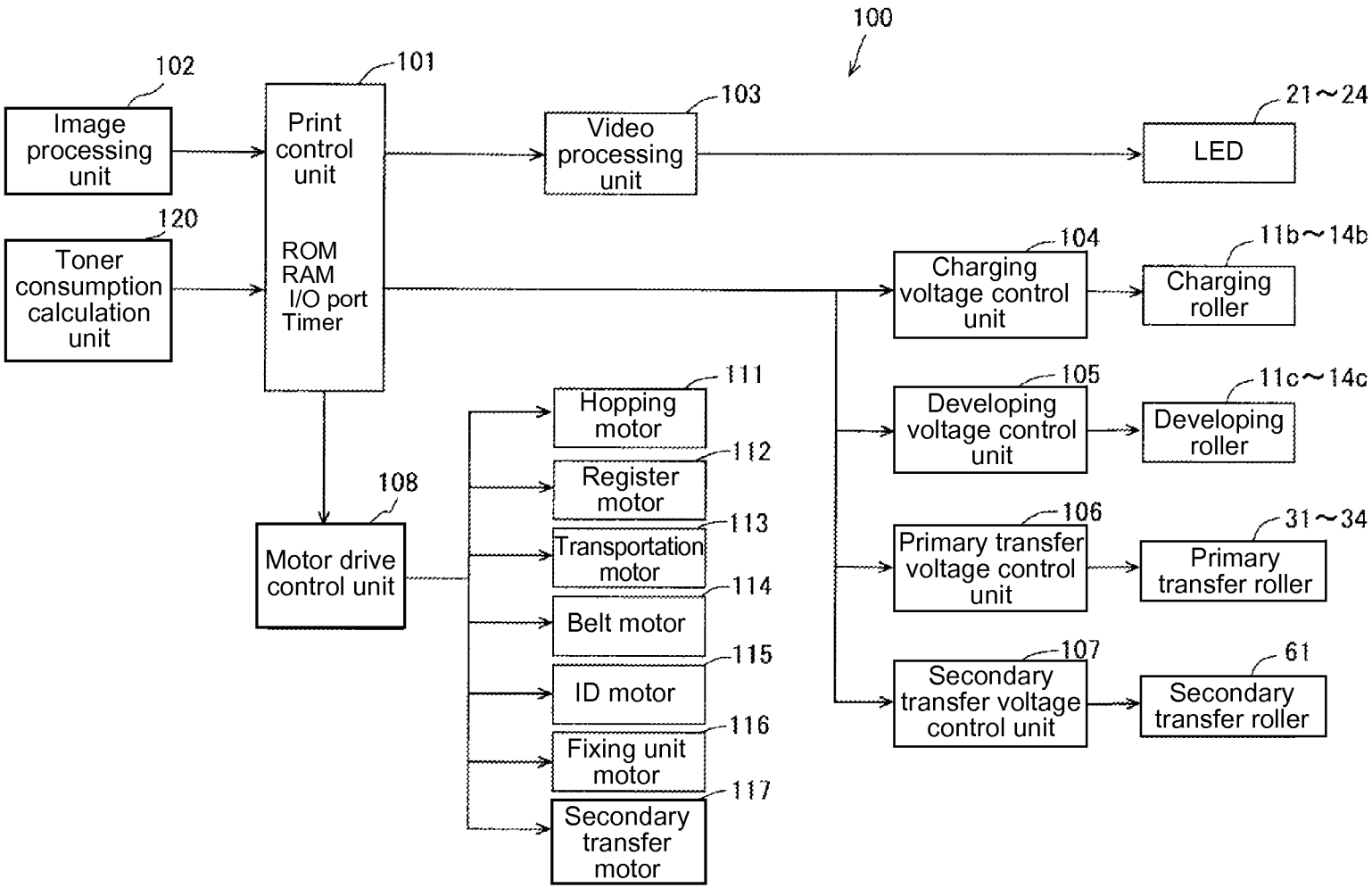
FIG. 2 is a block diagram showing a configuration of a control system of the printer for controlling an operation of the printer according to the first embodiment of the present invention.

FIG. 2 is a block diagram showing a configuration of a control system 100 of the printer 1 for controlling an operation of the printer 1 according to the first embodiment of the present invention.

As shown in FIG. 2, the control system 100 includes a print control unit 101 formed of a microprocessor, an ROM, an RAM, an I/O port, a timer, and the like. The print control 101 is provided for performing a mechanical component control and an applied voltage control through analyzing, calculating, and determining an information signal input from each sensor and each component (not shown), and through outputting an instruction signal to each component.

As shown in FIG. 2, the control system 100 further includes an image processing unit 102 for retrieving image data transmitted from a host computer at an upper stage, and for converting the image data to a printable data format. Further, the control system 100 includes a video processing unit 103 for outputting the image data converted with the image processing unit 102 to the LED heads 21 to 24. It is noted that the LED heads 21 to 24 are represented with one block in FIG. 2.

In the embodiment, the control system 100 further includes a motor drive control unit 108. The motor drive control unit 108 receives the instruction signal from the print control unit 101, and controls and drives each motor at a specific timing at a specific speed, i.e., the hopping motor 111 for driving the hopping roller 72 to rotate; the register motor 112 for driving the register roller pair 73 to rotate; the transportation motor 113 for driving the transportation rollers 74 and 75 and the transportation roller pair 76 to rotate; the belt motor 114 for driving the drive roller 51 to rotate to move the intermediate transfer belt 54 in the arrow direction A; the ID motor 115 for driving the rotational members of the ID units 11 to 14 to rotate; a fixing unit motor 116 for driving the heat roller 66 and the pressing roller 67 of the fixing unit 68 to rotate; and the secondary transfer motor 117 for driving the drive roller 62 to rotate to move the secondary transfer belt 63 in the arrow direction B.

In the embodiment, the control system 100 further includes a charging voltage control unit 104, a developing voltage control unit 105, a primary transfer voltage control unit 106, and a secondary transfer voltage control unit 107. Each of the voltage control unit 104, the developing voltage control unit 105, the primary transfer voltage control unit 106, and the secondary transfer voltage control unit 107 receives the instruction signal indicating an applied voltage from the print control unit 101, thereby applying the instructed voltage to the charging rollers 11*b* to 14*b* of the ID units 11 to 14, the developing rollers 11*c* to 14*c* of the ID units 11 to 14, the primary transfer rollers 31 to 34, and the secondary transfer belt 63, respectively.

In FIG. 2, it is noted that the charging rollers 11*b* to 14*b* of the ID units 11 to 14, the developing rollers 11*c* to 14*c* of the ID units 11 to 14, the primary transfer rollers 31 to 34, and the secondary transfer belt 63 are represented with single blocks for the purpose of simply explanation. Further, the control system 100 includes a toner consumption calculation unit 120 for calculating and storing a consumed amount of toner in each color consumed in a printing operation and the like (described later), and sends the consumed amount of toner to the print control unit 101.

An operation of the printer 1 in a normal printing operation will be explained next. When the printer 1 receives the image data transmitted from an external device such as a personal computer (not shown), the image processing unit 102 performs a data processing. After the image data is converted to the printable data format, the print control unit 101 starts the printing operation.

First, the print control unit 101 controls the belt motor 114, the ID motor 115, and the secondary transfer motor 117 through the motor drive control unit 108 to rotate. At the same time, the print control unit 101 sends the instruction signal indicating the applied voltage to the charging voltage control unit 104 and the developing voltage control unit 105, so that the specific voltage is applied to the charging rollers 11*b* to 14*b* and the developing rollers 11*c* to 14*c* of the ID units 11 to 14.

In the next step, after the photosensitive drums 11*a* to 14*a* are charged in a stable state, the video processing unit 103 transmits the image data thus processed to the LED heads 21 to 24. Then, the LED heads 21 to 24 illuminate LEDs corresponding to the image data thus transmitted, so that the static latent images are formed on the surfaces of the photosensitive drums 11*a* to 14*a* thus charged. After the static latent images are formed on the surfaces of the photosensitive drums 11*a* to 14*a*, the developing rollers 11*c* to 14*c* attach toner in each color to the static latent images to be developed, so that the toner images are formed in the areas on the surfaces of the photosensitive drums 11*a* to 14*a* where the static latent images are formed.

Further, the print control unit 101 transmits the instruction signal indicating the applied voltage to the developing voltage control unit 105. Accordingly, the specific voltage necessary for the transfer is applied to the primary transfer rollers 31 to 34 before a period of time during which the photosensitive drums 11*a* to 14*a* rotate at least from the contact portions with respect to the intermediate transfer belt 54 (the primary transfer positions) to a light exposure position before the static latent images are formed on the photosensitive drums 11*a* to 14*a*.

With the process described above, it is possible to minimize an effect of a difference in surface potentials of the photosensitive drums 11*a* to 14*a* on a later step (an exposure step and a developing step). As a result, the primary transfer rollers 31 to 34 overlap and transfer the toner images on the photosensitive drums 11*a* to 14*a* to the intermediate transfer belt 54 at each of the primary transfer positions, thereby forming the toner images in full colors.

In the next step, when the toner images formed on the intermediate transfer belt 54 reach the secondary transfer position, that is, the nip portion between the intermediate transfer belt 54 and the secondary transfer belt 63, the print control unit 101 transmits the instruction signal to the motor drive control unit 108, so that the hopping motor 111, the register motor 112, and the transportation motor 113 are driven to rotate. Accordingly, the hopping roller 72, the register roller pair 73, the transportation rollers 74 and 75, and the transportation roller pair 76 start rotating at a specific speed, so that the recording sheet 2 picked up from the recording medium storage cassette 71 is transported to the secondary transfer position.

In the embodiment, the print control unit 101 calculates a transmission start timing of the image data, the drive speed of the belt motor 114, and a period of time during which the toner images on the intermediate transfer belt 54 reach the secondary transfer position according to a distance between the primary transfer position and the secondary transfer position, and the like. Accordingly, the print control unit 101 controls the rotational timing and the rotational speed of the hopping motor 111, the register motor 112, and the transportation motor 113, so that the toner images on the intermediate transfer belt 54 are transferred (the secondary transfer) to a specific position of the recording sheet 2 thus transported.

Further, the print control unit 101 transmits the instruction signal indicating the applied voltage to the secondary transfer voltage control unit 107 at a timing when the recording sheet 2 reaches the secondary transfer position, so that the secondary transfer voltage with a polarity opposite to that of toner of the toner images on the intermediate transfer belt 54 is applied to the secondary transfer roller 61. For example, when toner is charged with negative charges, the voltage of plus 2,000 V is applied to the secondary transfer roller 61, so that the toner images on the intermediate transfer belt 54 are transferred (the secondary transfer) to the recording sheet 2.

After the toner images on the intermediate transfer belt 54 are transferred to the recording sheet 2, the recording sheet 2 is transported to the fixing unit 68, so that the heat roller 66 and the pressing roller 67 heat and press the recording sheet 2, thereby fixing the toner images. Afterward, the transportation roller pair 76 disposed at the later stage discharge the recording sheet 2 to the stacker portion 69 disposed outside the printer 1.

In the embodiment, after the toner images on the intermediate transfer belt 54 are transferred to the recording sheet 2, the cleaning blade 55 scrapes off a foreign matter such as toner remaining on the intermediate transfer belt 54, so that the foreign matter is collected in the cleaner container 56. The steps described above are repeated in the printing operation.

An operation of the printer 1 in a toner discarding operation will be explained next.

As explained above, the toner consumption calculation unit 120 is provided for calculating and storing the consumed amount of toner in each color consumed in each of the ID units 11 to 14 in the normal printing operation, and notifies one of the ID units 11 to 14 with a minimum consumed amount of toner to the print control unit 101. According to the notification from the toner consumption calculation unit 120, the print control unit 101 performs the toner discarding operation at an operation timing such as when the printer 1 is turned on, a cover of the printer 1 is opened or closed, a color shift is corrected, or the printing operation starts. Accordingly, it is possible to minimize deterioration of printing quality such as grayness deterioration due to deterioration of toner in the ID units 11 to 14.

In the embodiment, the print control unit 101 performs the toner discarding operation only in at least one of the ID units 11 to 14 notified as the one with the minimum consumed amount of toner until the operation timing. Accordingly, the number of the ID units in which the print control unit 101 performs the toner discarding operation may be between one and four depending on the consumed amount of toner in each of the ID units 11 to 14.

In the embodiment, the minimum consumed amount of toner is defined as, for example, a case in which a ratio of image dots per one A4 size sheet is less than 3% as opposed to the image dots of 100% when an entire area of one A4 size sheet is exposed (solid printing).

Figure 3:
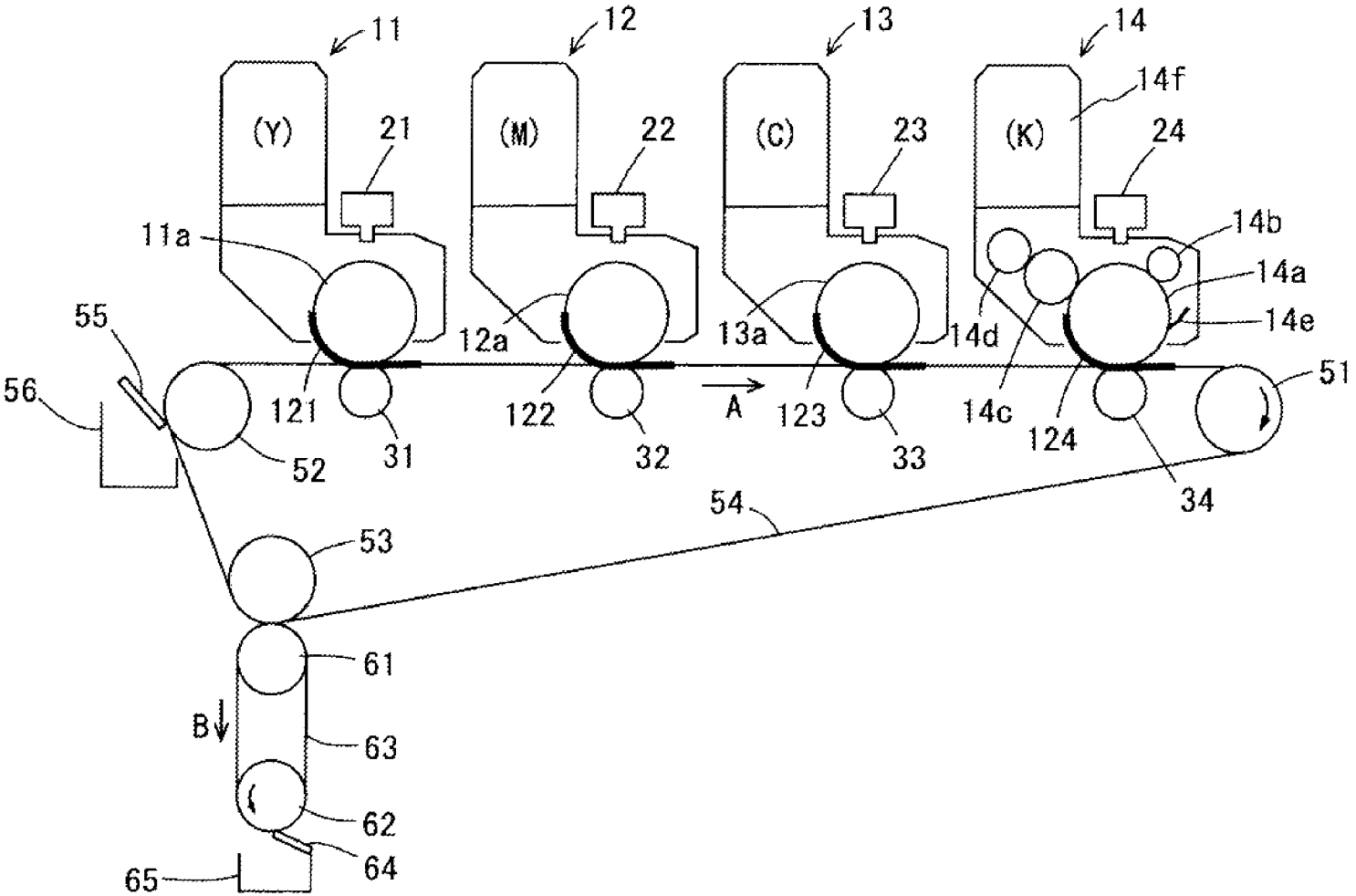
FIG. 3 is a schematic view showing an example of a toner discarding operation of the printer in four ID units at a specific operation timing according to the first embodiment of the present invention.

FIG. 3 is a schematic view showing an example of the toner discarding operation of the printer 1 in the ID units 11 to 14 at a specific operation timing according to the first embodiment of the present invention.

In the toner discarding operation, unlike the normal printing operation, in which it is necessary to overlap the toner images, the image forming process starts for all four colors simultaneously. Accordingly, as shown in FIG. 3, a discard toner image 121 in yellow (Y), a discard toner image 122 in magenta (M), a discard toner image 123 in cyan (C), and a discard toner image 124 in black (K) are formed on the photosensitive drums 11*a* to 14*a*. Each of the discard toner image 121, the discard toner image 122, the discard toner image 123, and the discard toner image 124 has a length not being overlapped with each other.

In the next step, the primary transfer rollers 31 to 34 transfer the discard toner image 121, the discard toner image 122, the discard toner image 123, and the discard toner image 124 to the intermediate transfer belt 54 substantially simultaneously. When the primary transfer rollers 31 to 34 transfer the discard toner image 121, the discard toner image 122, the discard toner image 123, and the discard toner image 124 are formed, a print pattern with 50% of an entire area is printed. It may be configured such that the print pattern has a length in the belt moving direction (the arrow direction A) appropriately set as an operational condition.

As explained above, the print control unit 101 performs the toner discarding operation depending on the consumed amount of toner in each of the ID units 11 to 14. Accordingly, not limited to the case that the toner discarding operation is performed for all four colors simultaneously as shown in FIG. 3, the toner discarding operation may be performed for three colors, two color, or one color.

Figure 4:
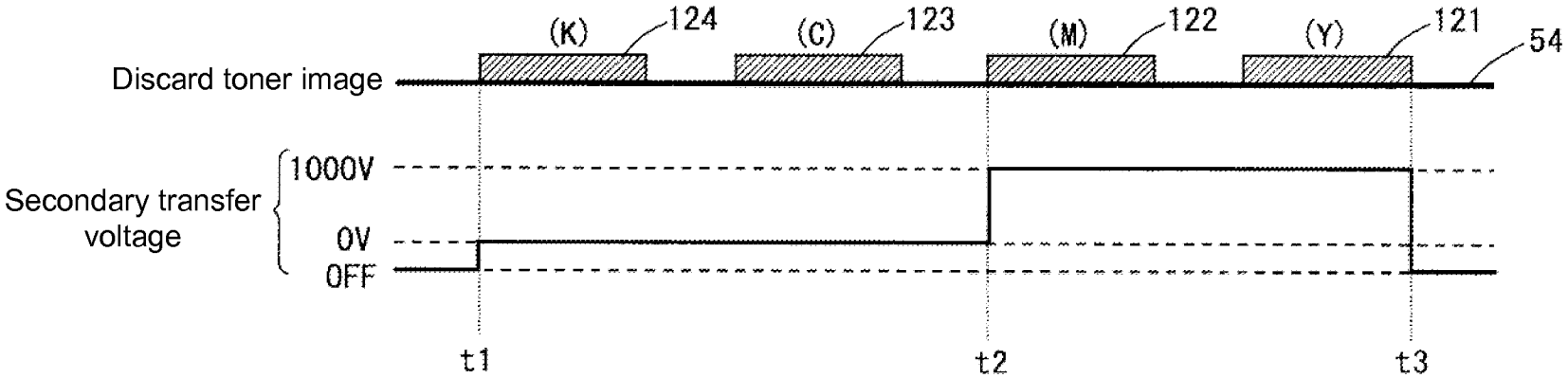
FIG. 4 is a time chart showing an example of an application of a secondary transfer voltage applied to a secondary transfer roller in the toner discarding operation of the printer according to the first embodiment of the present invention.

FIG. 4 is a time chart showing an example of an application of the secondary transfer voltage applied to the secondary transfer roller 61 in the toner discarding operation of the printer 1 according to the first embodiment of the present invention.

As explained above, among the ID units 11 to 14, the ID unit 14 situated at the most downstream side forms the discard toner image 124 in black (K). As shown in FIG. 4, the discard toner image 124 in black (K) reaches the secondary transfer position or the nip portion between the intermediate transfer belt 54 and the secondary transfer belt 63 at a timing t1. At the timing t1, the secondary transfer voltage is switched from an off state (a state that the secondary transfer voltage is not applied) to an on state (a state that the secondary transfer voltage is applied), so that the secondary transfer voltage of 0 V is applied to the secondary transfer roller 61.

In the next step, the discard toner image 122 in magenta (M) formed with the ID unit 12 situated at the third position from the most downstream side reaches the secondary transfer position at a timing t2. At the timing t2, the secondary transfer voltage applied to the secondary transfer roller 61 is changed from 0 V to 1,000 V. Then, the discard toner image 121 in yellow (Y) formed with the ID unit 11 situated at the most upstream side passes through the secondary transfer position at a timing t3. At the timing t3, the secondary transfer voltage is turned off.

Through the process described above, a majority portion of the discard toner image 124 in black (K) and the discard toner image 123 in cyan (C) are transported on the intermediate transfer belt 54 without being transferred at the secondary transfer position, and are scraped off with the cleaning blade 55. On the other hand, a majority portion of the discard toner image 122 in magenta (M) and the discard toner image 121 in yellow (Y) are transferred to the secondary transfer belt 63 at the secondary transfer position. Accordingly, the discard toner image 122 in magenta (M) and the discard toner image 121 in yellow (Y) are transported to the cleaning portion of the secondary transfer belt 63, and are scraped off with the cleaning blade 64.

In the embodiment, when the toner discarding operation is performed for the ID units 11 to 14, the discard toner images are divided into two groups in two colors, and are transported to the cleaning blade 55 and the cleaning blade 64, so that the cleaning blade 55 and the cleaning blade 64 remove the discard toner images. Alternatively, when the toner discarding operation is performed for one to three of the ID units 11 to 14, the discard toner images are divided adequately, and are transported to the cleaning blade 55 and the cleaning blade 64, so that the cleaning blade 55 and the cleaning blade 64 remove the discard toner images.

In the normal printing operation, when the toner image on the intermediate transfer belt 54 is transferred to the recording sheet 2, a small amount of toner (the remaining toner) remains on the intermediate transfer belt 54, so that the cleaning blade 55 scrapes off the remaining toner. In other words, when the normal printing operation is performed, the remaining toner is transported to the cleaning blade 55 of the intermediate transfer belt 54. Accordingly, when the toner discarding operation is performed for an odd number (one or three) of the ID units 11 to 14, it is preferred to adjust the secondary transfer voltage such that an amount A of the discard toner scraped off with the cleaning blade 55 becomes smaller than an amount B of the discard toner scraped off with the cleaning blade 64 (A<B).

In the embodiment, as explained above, when the consumed amount of toner is small, the print control unit 101 performs the toner discarding operation at the operation timing such as when the printer 1 is turned on, the cover of the printer 1 is opened or closed, the color shift is corrected, or the printing operation starts according to the notification from the toner consumption calculation unit 120. The present invention is not limited thereto. It may be configured such that, regardless of the consumed amount of toner, the print control unit 101 performs the toner discarding operation at the operation timing, regularly, or according to an instruction of a user.

In the embodiment, the printer 1 of the color printing compatible type with the ID units 11 to 14 is explained as an example. The present invention is not limited thereto, and may be applicable to a printer of a monochrome printing compatible type with one ID unit.

As described above, in the embodiment, the printer 1 is configured such that toner is supplied to the cleaning blade 64 of the secondary transfer belt 63 to function as lubricant. Accordingly, it is possible to minimize a problem such as an increase in friction (load), a noise generation, and a cleaning trouble due to a blade flipping and the like at the contact portion between the secondary transfer belt 63 and the cleaning blade 64.

Second Embodiment

Figure 5:
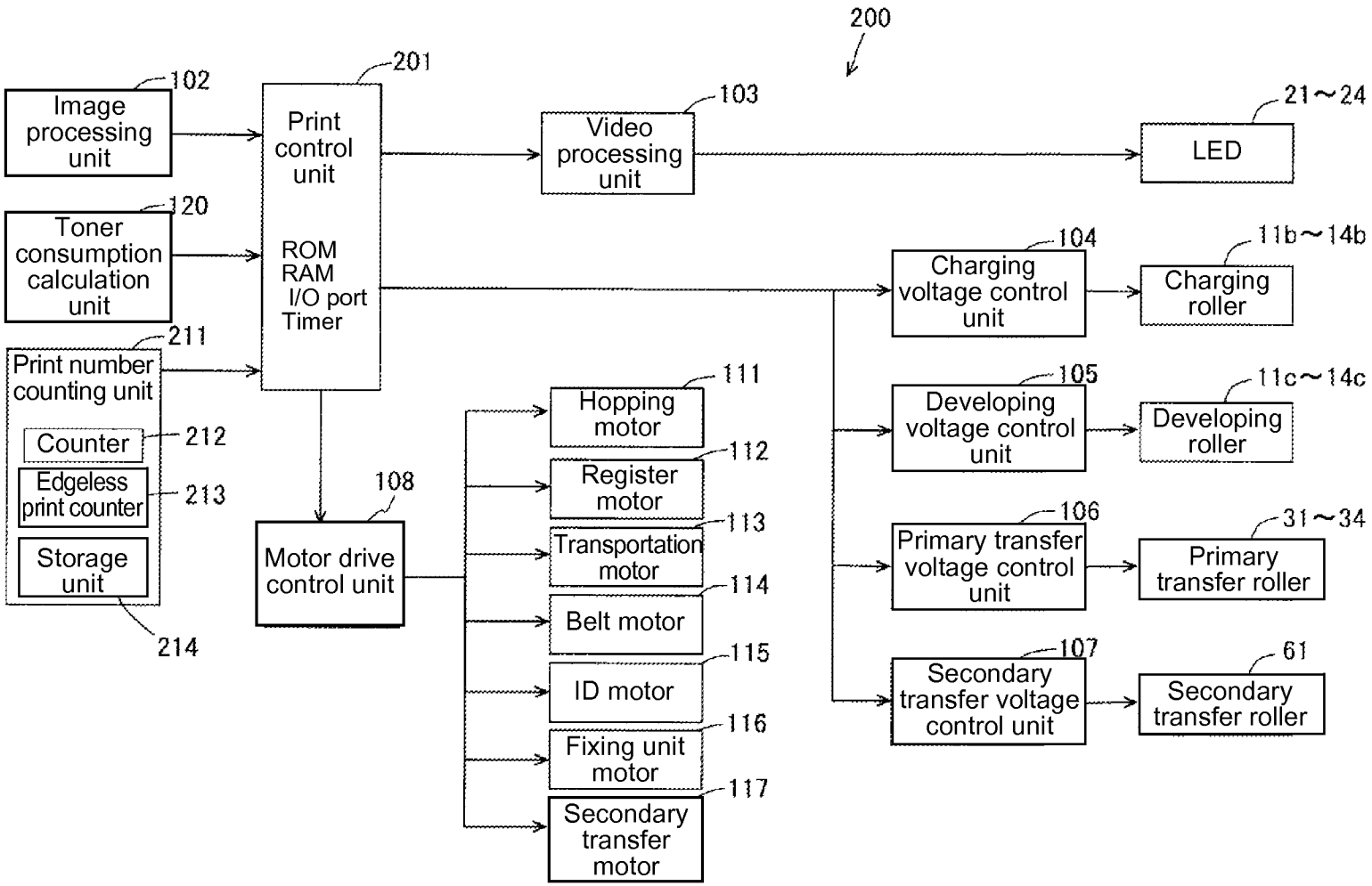
FIG. 5 is a block diagram showing a configuration of a control system of a printer for controlling an operation of the printer according to a second embodiment of the present invention.

A second embodiment of the present invention will be explained next. FIG. 5 is a block diagram showing a configuration of a control system 200 of the printer 1 for controlling an operation of the printer 1 according to the second embodiment of the present invention.

In the second embodiment, different from the control system 100 in the first embodiment, the control system 200 includes a print number counting unit 211. Components of the printer 1 in the second embodiment similar to those in the printer 1 in the first embodiment (refer to FIG. 1) are designated with the same reference numerals, and explanations thereof are omitted. A large number of the components of the printer 1 in the second embodiment except the control system 200 are similar to those in the printer 1 in the first embodiment, and the printer in the second embodiment is explained with reference to FIG. 1 as necessary.

In the embodiment, the control system 200 includes a print control unit 201 for performing a mechanical component control and an applied voltage control (described later), so that the toner image is formed in an area exceeding the sheet size of the recording sheet 2. The print number counting unit 211 includes a counter 212 for counting a print number; an edgeless print counter 213 for counting a print number of recording sheets on which the toner image is formed in the area exceeding the sheet size of the recording sheet 2 (referred to as an edgeless printing operation); and a storage unit 214 for storing a value (N) of the counter 212 and a value (n) of the edgeless print counter 213. In contrast to the edgeless printing operation, the toner image is formed in an area within the sheet size of the recording sheet 2 in a within edge printing operation.

An operation of the printer 1 will be explained next. An operation of the printer 1 in the within edge printing operation in the normal printing operation is similar to the normal printing operation of the printer 1 in the first embodiment, and explanations thereof are omitted.

Figure 6:
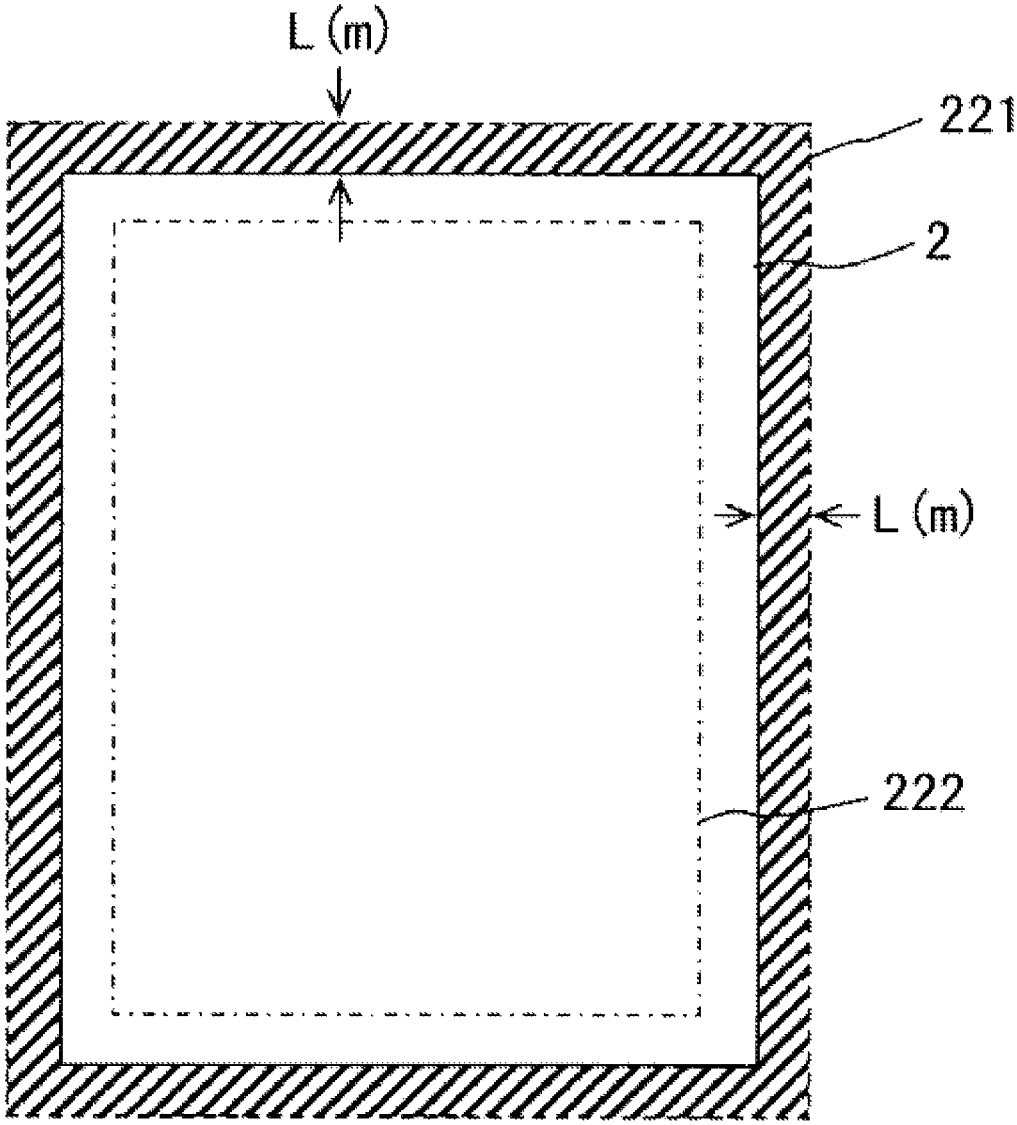
FIG. 6 is a schematic view showing a sheet size of a recording sheet, a printing area in a within edge printing operation (an area surrounded with a projected line), and a printing area in an edgeless printing operation (an area surrounded with a hidden line) according to the second embodiment of the present invention.

In the edgeless printing operation in the normal printing operation, as shown in FIG. 6, the print control unit 201 controls the components to form the toner image on the intermediate transfer belt 54 such that the toner image exceeds the sheet size of the recording sheet 2 by an over amount L (mm). Further, the print control unit 201 transmits the instruction signal to the motor drive control unit 108 to transport the recording sheet 2 to the secondary transfer position at the same timing as that in the within edge printing operation. Accordingly, the motor drive control unit 108 controls the hopping motor 111, the register motor 112, and the transportation motor 113 to drive the hopping roller 72, the register roller pair 73, the transportation rollers 74 and 75, and the transportation roller pair 76 to rotate, respectively.

In the embodiment, the print control unit 201 transmits the instruction signal to the secondary transfer voltage control unit 107 at a timing before the recording sheet 2 reaches the secondary transfer position by the over amount L (mm), so that the secondary transfer voltage with a polarity opposite to that of toner of the toner image on the intermediate transfer belt 54 is applied to the secondary transfer roller 61. It is noted that instead of the over amount L (mm), the secondary transfer voltage may be applied to the secondary transfer roller 61 before the recording sheet 2 reaches the secondary transfer position.

FIG. 6 is a schematic view showing the sheet size of the recording sheet 2, a printing area 222 in the within edge printing operation (an area surrounded with a projected line), and a printing area 221 in the edgeless printing operation (an area surrounded with a hidden line) according to the second embodiment of the present invention.

In the within edge printing operation, the toner image is formed in the printing area 222 within the sheet side of the recording sheet 2. Accordingly, when the secondary transfer is performed, toner does not adhere to the secondary transfer belt 63. On the other hand, the edgeless printing operation, the toner image is formed in the printing area 221 and exceeds the sheet side of the recording sheet 2. Accordingly, when the secondary transfer is performed, toner in an over area (a hatching area) is transferred to the secondary transfer belt 63, so that the cleaning blade 64 scrapes off toner to be collected in the cleaner container 65. At this moment, in the print number counting unit 211, the counter 212 counts a sum of the printing numbers (N and n) of the recording sheets 2 printed in the within edge printing operation and the edgeless printing operation, and the edgeless print counter 213 counts the printing number (n) of the recording sheets 2 printed in the edgeless printing operation. Further, the storage unit 214 stores the printing numbers (N and n) of the recording sheets 2 printed in the within edge printing operation and the edgeless printing operation.

Figure 7:
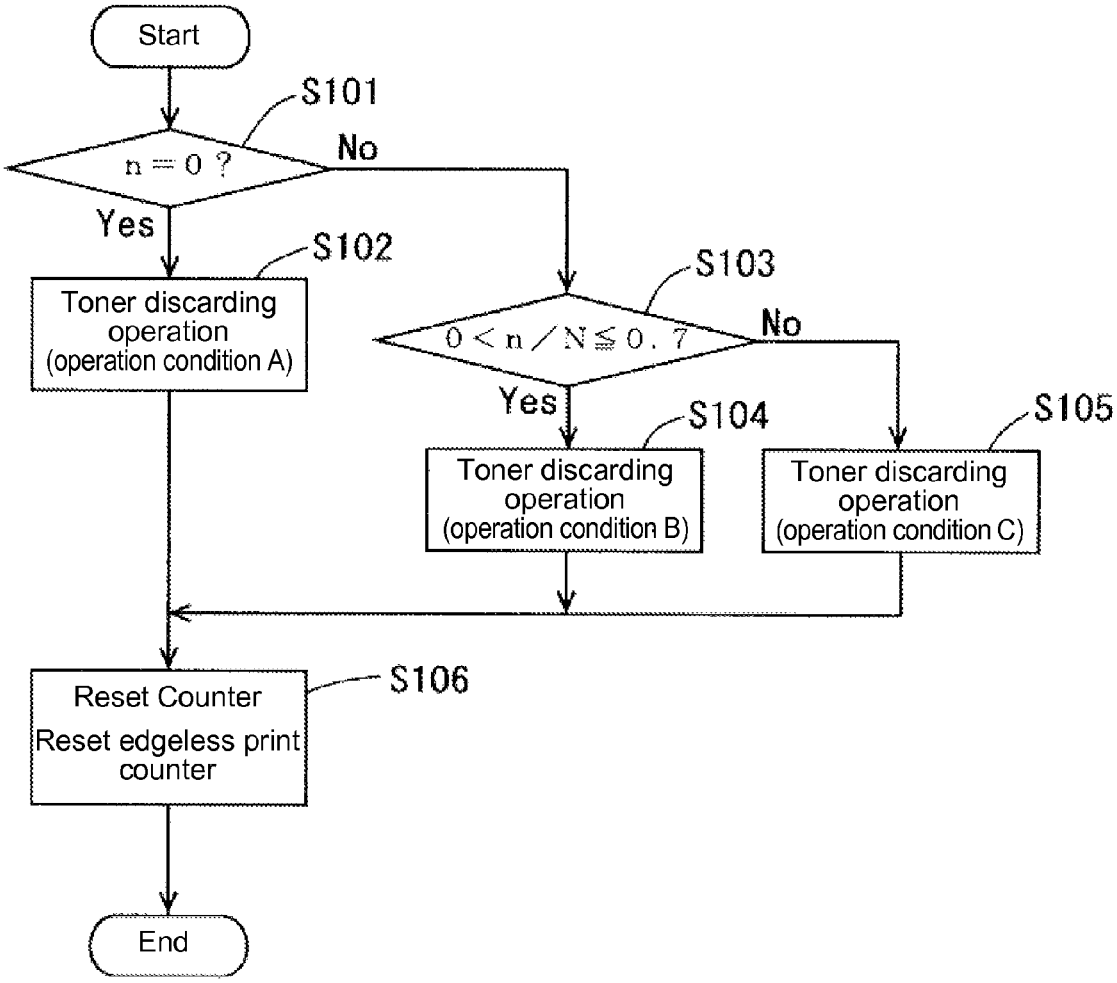
FIG. 7 is a flow chart showing a toner discarding operation of the printer according to the second embodiment of the present invention.

An operation of the printer 1 in the toner discarding operation will be explained next with reference to FIG. 7. FIG. 7 is a flow chart showing the toner discarding operation of the printer 1 according to the second embodiment of the present invention.

In the second embodiment, the toner discarding operation is performed at the timing similar to that of the toner discarding operation in the first embodiment. That is, according to the notification from the toner consumption calculation unit 120, the print control unit 201 performs the toner discarding operation at an operation timing such as when the printer 1 is turned on, a cover of the printer 1 is opened or closed, a color shift is corrected, or the printing operation starts.

In the second embodiment, the print control unit 201 performs the toner discarding operation only in at least one of the ID units 11 to 14 notified as the one with the minimum consumed amount of toner until the operation timing. Accordingly, the number of the ID units in which the print control unit 101 performs the toner discarding operation may be between one and four depending on the consumed amount of toner in each of the ID units 11 to 14.

In step S101, when the toner discarding operation starts, the print control unit 201 refers to and determines whether the count value (n) of the edgeless print counter 213 stored in the storage unit 214 is zero (n=0). In step S102, when the print control unit 201 determines that the count value (n) of the edgeless print counter 213 is zero (step S101, Yes), the print control unit 201 performs the toner discarding operation according to an operation condition A (described later), and the process proceeds to step S106.

When the print control unit 201 determines that the count value (n) of the edgeless print counter 213 is zero (n=0), it is indicated that the edgeless printing operation is not performed in the normal printing operation after the previous toner discarding operation was performed. That is, the toner discarding operation is performed in a situation where toner is not attached to the secondary transfer belt 63. Accordingly, in the operation condition A in step S102, the secondary transfer voltage is controlled such that the amount A of the discard toner scraped off with the cleaning blade 55 of the intermediate transfer belt 54 becomes smaller than the amount B of the discard toner scraped off with the cleaning blade 64 of the secondary transfer belt 63 (A<B).

As explained above, in the second embodiment, similar to the first embodiment, the print control unit 201 performs the toner discarding operation only in at least one of the ID units 11 to 14 notified as the one with the minimum consumed amount of toner calculated with the toner consumption calculation unit 120. Accordingly, as explained with reference to FIGS. 3 and 4, the discard toner image 121, the discard toner image 122, the discard toner image 123, and the discard toner image 124 may not be formed simultaneously, and only three, two or one of the discard toner image 121, the discard toner image 122, the discard toner image 123, and the discard toner image 124 may formed.

Accordingly, under the operation condition A, when toner in all four colors is discarded, the secondary transfer voltage is controlled such that toner in three colors is discarded in the amount B and toner in one color is discarded in the amount A. Similarly, when toner in three colors is discarded, the secondary transfer voltage is controlled such that toner in two colors is discarded in the amount B and toner in one color is discarded in the amount A. Further, when toner in one color is discarded, the secondary transfer voltage is controlled such that toner in one color is discarded in the amount B. When toner in two colors is discarded, the secondary transfer voltage is controlled such that toner in one color is discarded in the amount B and toner in one color is discarded in the amount A. The secondary transfer voltage is applied in the way similar to that in the first embodiment, and explanations thereof are omitted.

On the other hand, when the print control unit 201 determines that the count value (n) of the edgeless print counter 213 is not zero (step S101, No), the print control unit 201 determines a ratio of the print number in the edgeless printing operation relative to a total print number. More specifically, in step S103, the print control unit 201 determines whether the ratio of the count value (n) to the count value (N) is between zero and 0.7 ($0<n/N\leq0.7$). In step S104, when the print control unit 201 determines that the ratio of the count value (n) to the count value (N) is between zero and 0.7 ($0<n/N\leq0.7$) (step S103, Yes), the print control unit 201 performs the toner discarding operation according to an operation condition B (described later), and the process proceeds to step S106.

When the print control unit 201 determines that the ratio of the count value (n) to the count value (N) is between zero and 0.7 ($0<n/N\leq0.7$), it is indicated that the edgeless printing operation is performed in the normal printing operation to some extent after the previous toner discarding operation was performed. That is, toner in the over area (the hatching area) shown in FIG. 6 is transferred to the secondary transfer belt 63, so that the toner discarding operation is performed in a situation where it is determined that toner is adequately supplied to the cleaning blade 64. Accordingly, in the operation condition B in step S104, the secondary transfer voltage is controlled such that the amount A of the discard toner scraped off with the cleaning blade 55 of the intermediate transfer belt 54 becomes equal to or smaller than the amount B of the discard toner scraped off with the cleaning blade 64 of the secondary transfer belt 63 ($A\leq B$).

Accordingly, under the operation condition B, when toner in all four colors is discarded, the secondary transfer voltage is controlled such that toner in two colors is discarded in the amount B and toner in two colors is discarded in the amount A. Similarly, when toner in three colors is discarded, the secondary transfer voltage is controlled such that toner in two colors is discarded in the amount B and toner in one color is discarded in the amount A. Further, when toner in two colors is discarded, the secondary transfer voltage is controlled such that toner in one color is discarded in the amount B and toner in one color is discarded in the amount A. When toner in one color is discarded, the secondary transfer voltage is controlled such that toner in one color is discarded in the amount B.

On the other hand, when the print control unit 201 determines that the ratio of the count value (n) to the count value (N) is not between zero and 0.7 (for example, $0.7<n/N\leq1.0$)

(step S103, No), the print control unit 201 performs the toner discarding operation according to an operation condition C (described later) in step S105, and the process proceeds to step S106.

When the print control unit 201 determines that the ratio of the count value (n) to the count value (N) is not between zero and 0.7 ($0<n/N\leq 0.7$), it is indicated that the edgeless printing operation is frequently performed in the normal printing operation after the previous toner discarding operation was performed. That is, toner in the over area (the hatching area) shown in FIG. 6 is transferred to the secondary transfer belt 63, so that the toner discarding operation is performed in a situation where it is determined that toner is sufficiently supplied to the cleaning blade 64. Accordingly, in the operation condition C in step S105, the secondary transfer voltage is controlled such that the amount A of the discard toner scraped off with the cleaning blade 55 of the intermediate transfer belt 54 becomes equal to or greater than the amount B of the discard toner scraped off with the cleaning blade 64 of the secondary transfer belt 63 ($A\leq B$).

Accordingly, under the operation condition C, when toner in all four colors is discarded, the secondary transfer voltage is controlled such that toner in two colors is discarded in the amount B and toner in two colors is discarded in the amount A. Similarly, when toner in three colors is discarded, the secondary transfer voltage is controlled such that toner in one color is discarded in the amount B and toner in two color is discarded in the amount A. Further, when toner in two colors is discarded, the secondary transfer voltage is controlled such that toner in one color is discarded in the amount B and toner in one color is discarded in the amount A. When toner in one color is discarded, the secondary transfer voltage is controlled such that toner in one color is discarded in the amount A.

In step S106, after the toner discarding operation is performed under one of the operation conditions A to C, the counter 212 and the edgeless print counter 213 are reset (the count value n and the count value N are cleared), thereby completing the process.

As explained above, in the printer 1 in the second embodiment, depending on the frequency of the edgeless printing operation in the normal printing operation, the discard toner in the toner discarding operation is adjusted and supplied to the cleaning blade 55 of the intermediate transfer belt 54 and the cleaning blade 64 of the secondary transfer belt 63. Accordingly, it is possible to supply toner properly to each of the cleaning blade 55 and the cleaning blade 64. Accordingly, it is possible to minimize a problem such as an increase in friction (load), a noise generation, and a cleaning trouble due to a blade flipping and the like at the contact portion between the secondary transfer belt 63 and the cleaning blade 64.

In the embodiments described above, the secondary transfer belt 63 is provided for performing the secondary transfer operation. Alternatively, the present invention may be applicable to a configuration, in which a secondary transfer roller directly transfers without using the secondary transfer belt 63, and the secondary transfer roller is provided with a cleaning blade.

In the embodiments described above, the present invention is applied to the printer 1 of the intermediate transfer type. The present invention is not limited thereto, and may be applicable to a facsimile, a copier, an MFP (a multi function peripheral), and the like.

The disclosure of Japanese Patent Application No. 2010-193118, filed on Aug. 31, 2010, is incorporated in the application by reference.

While the invention has been explained with reference to the specific embodiments of the invention, the explanation is illustrative and the invention is limited only by the appended claims.

What is claimed is:

1. An image forming apparatus, comprising:

a plurality of developer image forming portions for forming developer images in, a plurality of colors;

a plurality of primary transfer members for transferring the developer images to an intermediate transfer member;

a secondary transfer member for transferring the developer images to a recording medium;

a medium transportation unit for transporting the recording medium to a secondary transfer position where the secondary transfer member transfers the developer images to the recording medium;

a first contact cleaning member for cleaning the intermediate transfer member, said first contact cleaning member being arranged to contact with the intermediate transfer member on a downstream side of the secondary transfer member in a transportation direction of the recording medium;

a second contact cleaning member, for cleaning the secondary transfer member;

a voltage control unit for applying a transfer voltage to the primary transfer members and the secondary transfer member;

a print number counting unit for counting a first print number of the recording media to be printed and a second print number of the recording media to be printed in an edgeless printing operation in which the developer image is formed in an area greater than the recording media; and a control unit for controlling the developer image portions, the primary transfer members, the secondary transfer member and the medium transportation unit, said control unit being arranged to perform a developer discarding operation, wherein, in the developer discarding operation, the developer image forming portions form a first discard developer image and a second discard developer image at different positions not to overlap with each other, the first and second discard developer images are transferred to the intermediate transfer member, the first contact cleaning member removes the first discard developer image without transferring the first discard developer image to the secondary transfer member, the second discard developer image is transferred to the secondary transfer member, the second contact cleaning member removes the second discard developer image, the voltage control unit is configured to apply a first transfer voltage to the secondary transfer member when the first discard developer image passes through the secondary transfer member, the voltage control unit is configured to apply a second transfer voltage different from the first transfer voltage to the secondary transfer member when the second discard developer image passes through the secondary transfer member, and said control unit is arranged to control the voltage control unit so that an amount of developer of the discard developer images that is transferred to the secondary transfer member is greater than that of developer of the discard developer images that is not transferred to the secondary transfer member according to a ratio of the second print number relative to the first print number.

2. The image forming apparatus according to claim 1, further comprising a consumption calculation unit for determining a remaining amount of developer, said control unit being arranged to control at least one of the developer image forming portions to form at least one of the first discard developer image and the second discard developer image in one of the colors in the developer discarding operation when the consumption calculation unit determines that the remaining amount of developer in the one of the colors is smaller than a specific level.

3. The image forming apparatus according to claim 2, wherein said control unit is arranged to perform the developer discarding operation at a specific timing when the consumption calculation unit determines that the amount of developer in the one of the colors is smaller than the specific level.

4. The image forming apparatus according to claim 1, wherein said control unit is arranged to perform the developer discarding operation at a constant interval.

5. The image forming apparatus according to claim 1, wherein said control unit is arranged to control the voltage control unit so that developer is transferred to the secondary transfer member in an amount greater than that of developer not transferred to the secondary transfer member.

6. The image forming apparatus according to claim 1, wherein said control unit is arranged to perform the developer discarding operation at a specific timing when the image forming apparatus is turned on, a cover of the image forming apparatus is opened or closed, a color shift is corrected, or a printing operation of the image forming apparatus starts.

7. The image forming apparatus according to claim 1, wherein said intermediate transfer member is formed of an intermediate transfer belt.

8. The image forming apparatus according to claim 1, wherein said secondary transfer member includes a secondary transfer roller, a drive roller and a secondary transfer belt extended between the secondary transfer roller and the drive roller.

9. The image forming apparatus according to claim 1, wherein said contact cleaning member is formed of a cleaning blade.

10. The image forming apparatus according to claim 1, wherein said, developer image forming portions are configured to form the first discard developer image and the second discard developer image at the different positions with a blank space in between.

11. The image forming apparatus according to claim 10, wherein said voltage control unit is configured to switch between the first transfer voltage and the second transfer voltage when the blank space passes through the secondary transfer member.

12. The image forming apparatus according to claim 1, wherein said primary transfer members includes a first primary transfer member for transferring the first discard developer image to the intermediate transfer member and a second primary transfer member for transferring the second discard developer image to the intermediate transfer member, and said developer image forming portions form the first discard developer image and the second discard developer image at the different positions at the same time.

* * * * *